US009970144B2

(12) United States Patent
Won et al.

(10) Patent No.: US 9,970,144 B2
(45) Date of Patent: May 15, 2018

(54) LAUNDRY TREATMENT APPARATUS

(71) Applicant: LG ELECTRONICS INC., Seoul (KR)

(72) Inventors: Woonghui Won, Seoul (KR); Jinwoo Seo, Seoul (KR); Wooseong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 135 days.

(21) Appl. No.: 14/812,329

(22) Filed: Jul. 29, 2015

(65) Prior Publication Data

US 2016/0032514 A1 Feb. 4, 2016

(30) Foreign Application Priority Data

Aug. 1, 2014 (KR) ..... 10-2014-0098830

(51) Int. Cl.
*D06F 37/20* (2006.01)
*D06F 29/00* (2006.01)
(Continued)

(52) U.S. Cl.
CPC ..... *D06F 37/20* (2013.01); *D06F 29/00* (2013.01); *D06F 37/24* (2013.01); *D06F 37/268* (2013.01)

(58) Field of Classification Search
CPC ..... D06F 29/00; D06F 31/00; D06F 37/268; D06F 37/24
(Continued)

(56) References Cited

U.S. PATENT DOCUMENTS 2,467,639 A * 4/1949 Tornblom ..... H02G 3/083 248/343
5,606,879 A * 3/1997 Froelicher ..... D06F 37/20 188/129
(Continued)

FOREIGN PATENT DOCUMENTS

CN 1349012 5/2002
CN 1576679 2/2005
(Continued)

OTHER PUBLICATIONS

Machine translation of JPH10328481A, dated Dec. 1998.*
(Continued)

*Primary Examiner* — Michael E Barr
*Assistant Examiner* — Kevin G Lee
(74) *Attorney, Agent, or Firm* — Fish & Richardson P.C.

(57) ABSTRACT

A laundry treatment apparatus includes a main washing apparatus and a secondary washing apparatus that includes a cabinet, a drawer housing within the cabinet, a tub in the drawer for receiving washing water, hanging couplers provided at an outer circumferential surface of the tub and spaced apart from each other, suspending couplers provided at the drawer housing and positioned at locations corresponding to the hanging couplers, a drum rotatably provided in the tub, and suspension assemblies provided between the drawer housing and the tub to attenuate horizontal and vertical vibrations of the tub, the suspension assemblies being disposed between respective hanging couplers and suspending couplers to support the tub. Each of the suspension assemblies includes a support bar, support members at both ends of the support bar through which the support bar extends, and an elastic member disposed on the support member provided at one end of the support bar.

20 Claims, 7 Drawing Sheets

(51) Int. Cl.
*D06F 37/24* (2006.01)
*D06F 37/26* (2006.01)

(58) Field of Classification Search
USPC ..... 68/23.1, 23.3
See application file for complete search history.

(56) References Cited

U.S. PATENT DOCUMENTS

| | | | | |
|---|---|---|---|---|
| 5,884,891 | A * | 3/1999 | Hawkins | D06F 37/24 248/288.31 |
| 6,474,113 | B1 * | 11/2002 | Park | D06F 37/24 68/23.3 |
| 2002/0042957 | A1 | 4/2002 | Kim et al. | |
| 2006/0059960 | A1 * | 3/2006 | Hansen | D06F 37/24 68/23.1 |
| 2010/0064736 | A1 | 3/2010 | Jeong et al. | |
| 2011/0265524 | A1 | 11/2011 | Kim et al. | |

FOREIGN PATENT DOCUMENTS

| | | |
|---|---|---|
| CN | 102844486 | 12/2012 |
| EP | 2857569 | 4/2015 |
| JP | H01-317481 | 12/1989 |
| JP | H06-007583 | 1/1994 |
| JP | H10-328481 | 12/1998 |
| JP | 200761591 | 3/2007 |
| KR | 20020006807 | 1/2002 |

OTHER PUBLICATIONS

Extended European Search Report issued in European Application No. 15178806.4 dated Oct. 20, 2015, 8 pages.
Chinese Office Action in Chinese Application No. 201510463355.9, dated Feb. 27, 2017, 19 pages (with English translation).

* cited by examiner

【Figure 1】
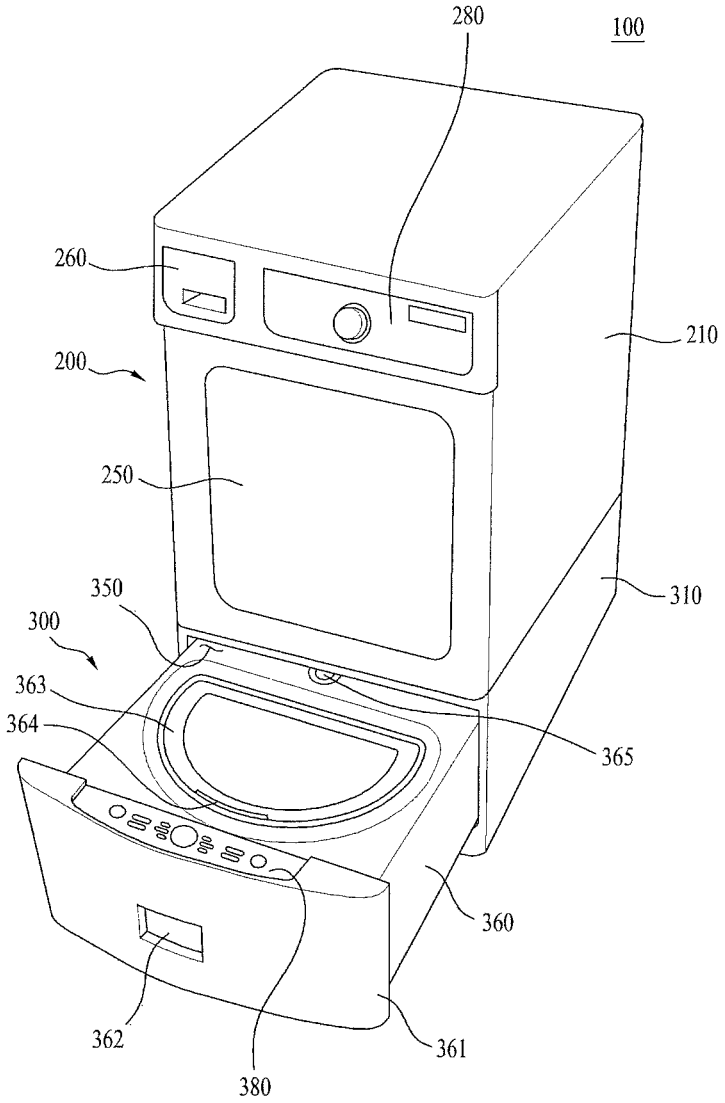

【Figure 2】
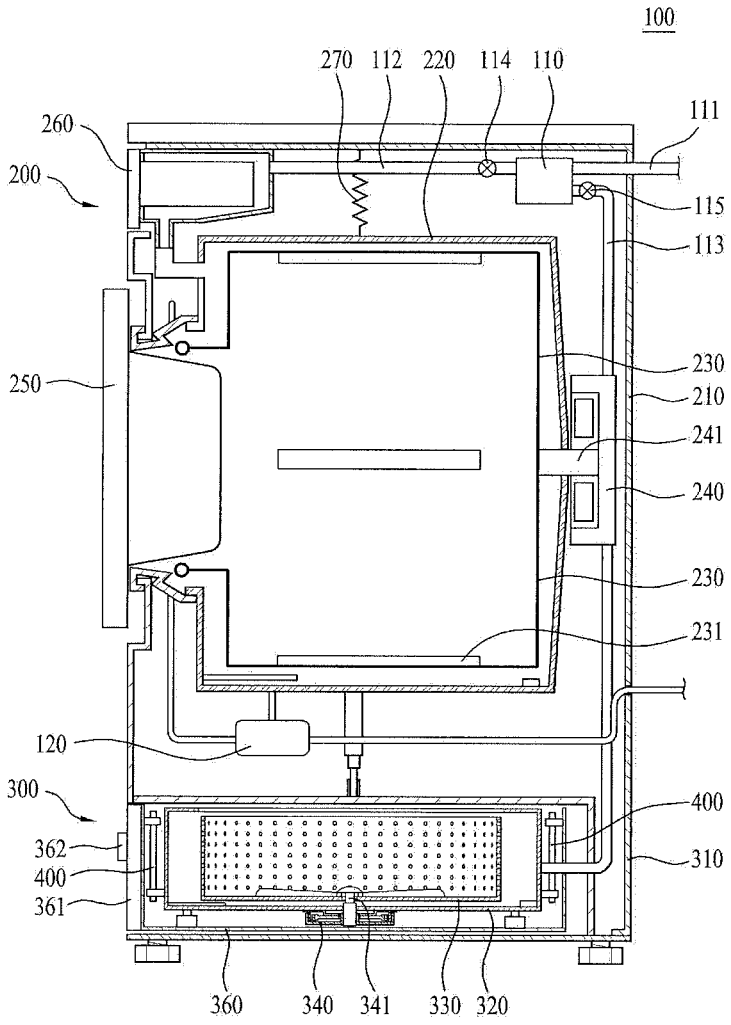

【Figure 3】
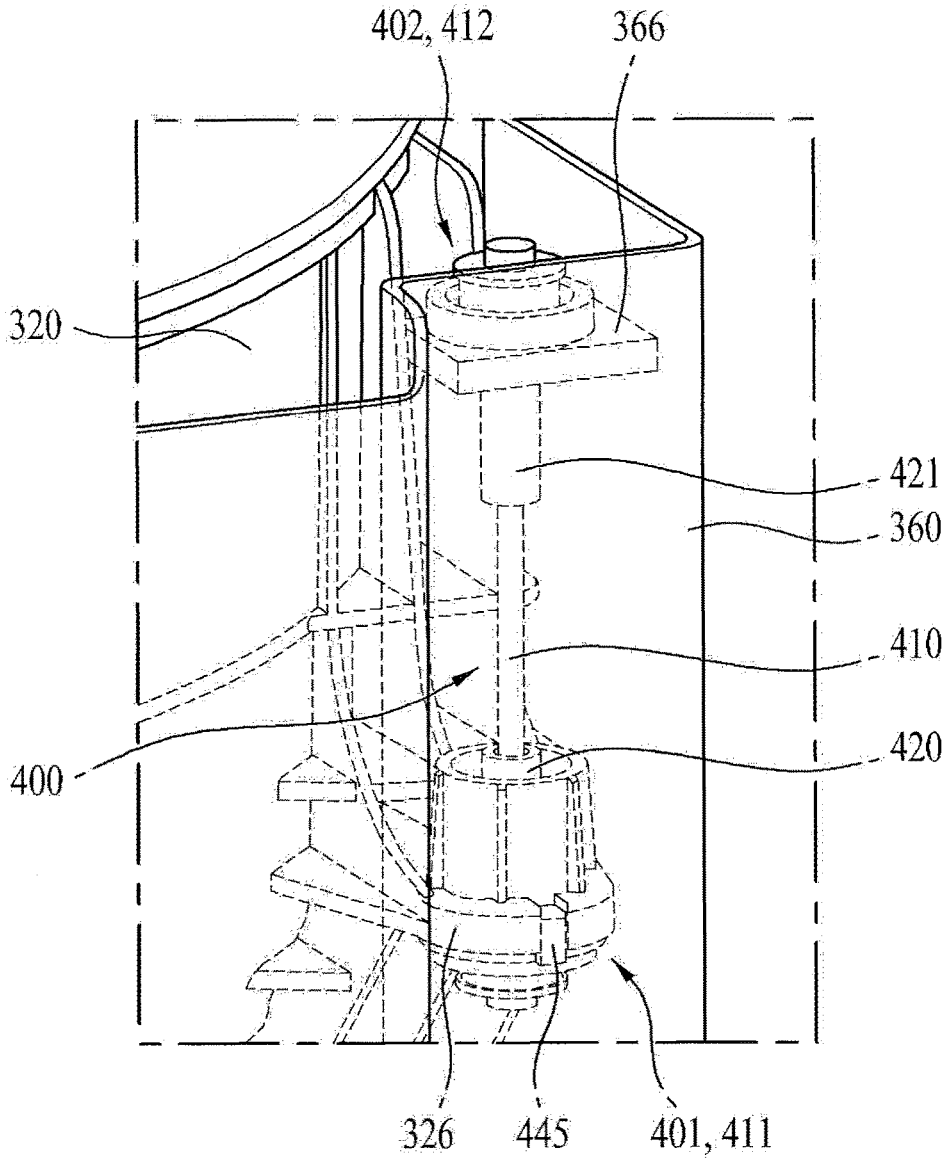

【Figure 4】
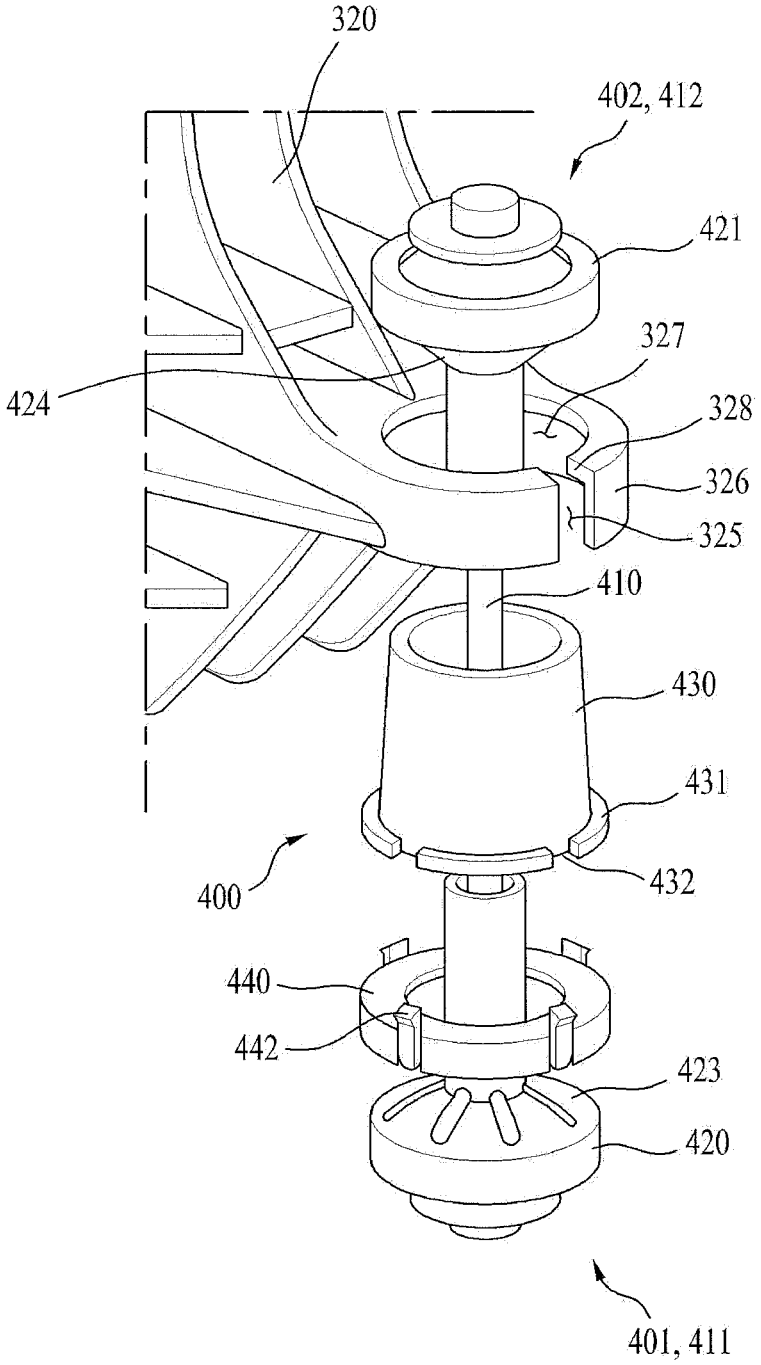

【Figure 5】
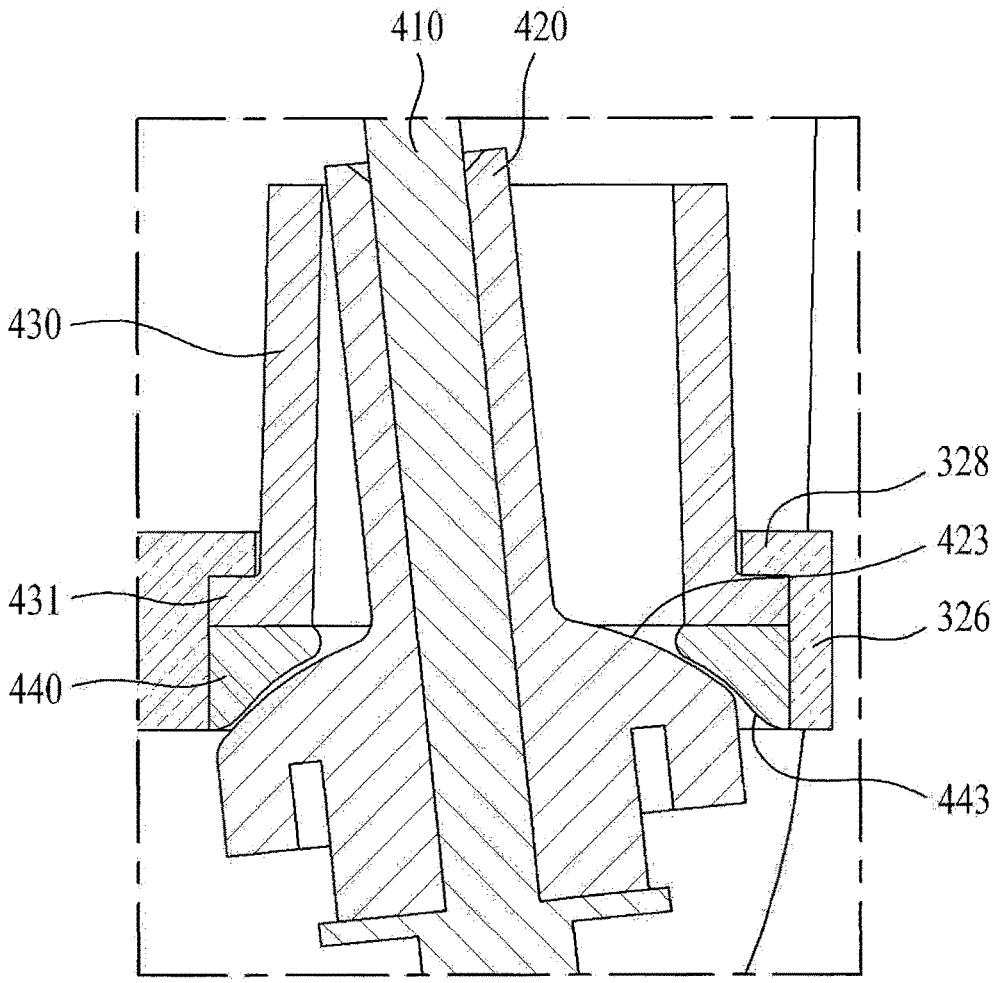

【Figure 6】
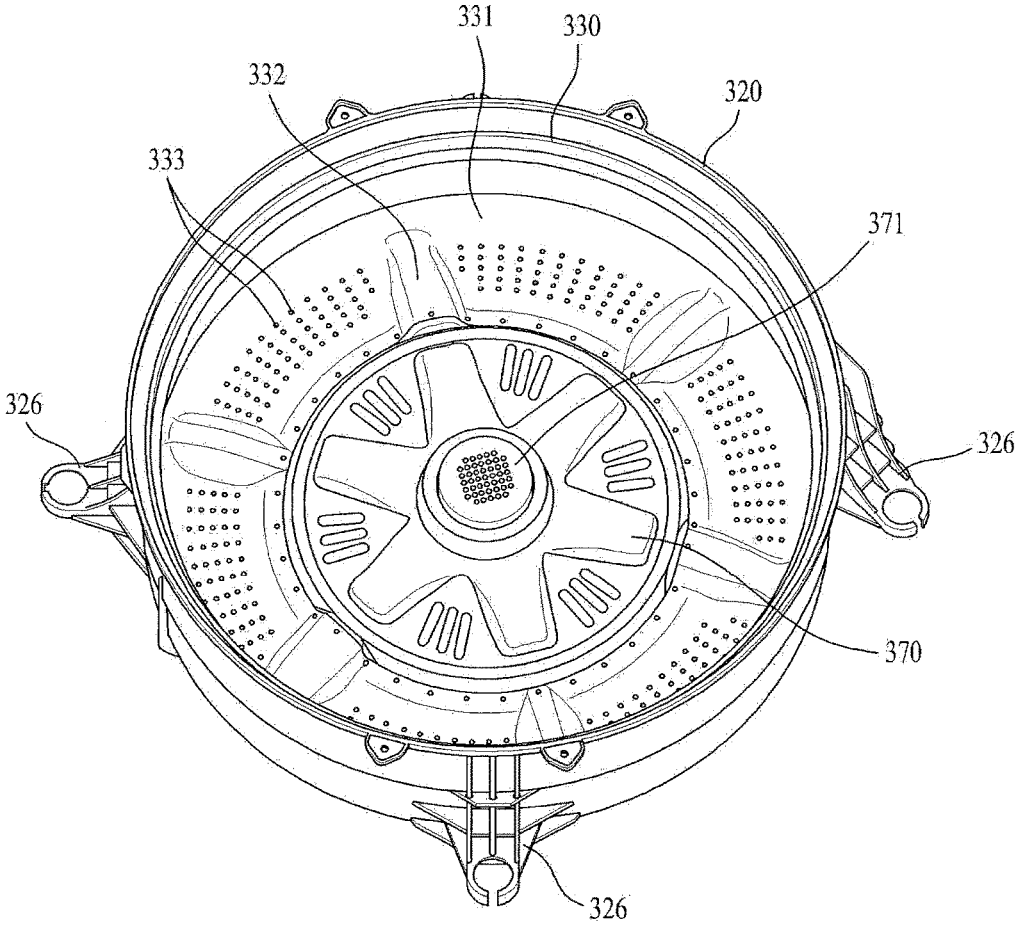

【Figure 7】
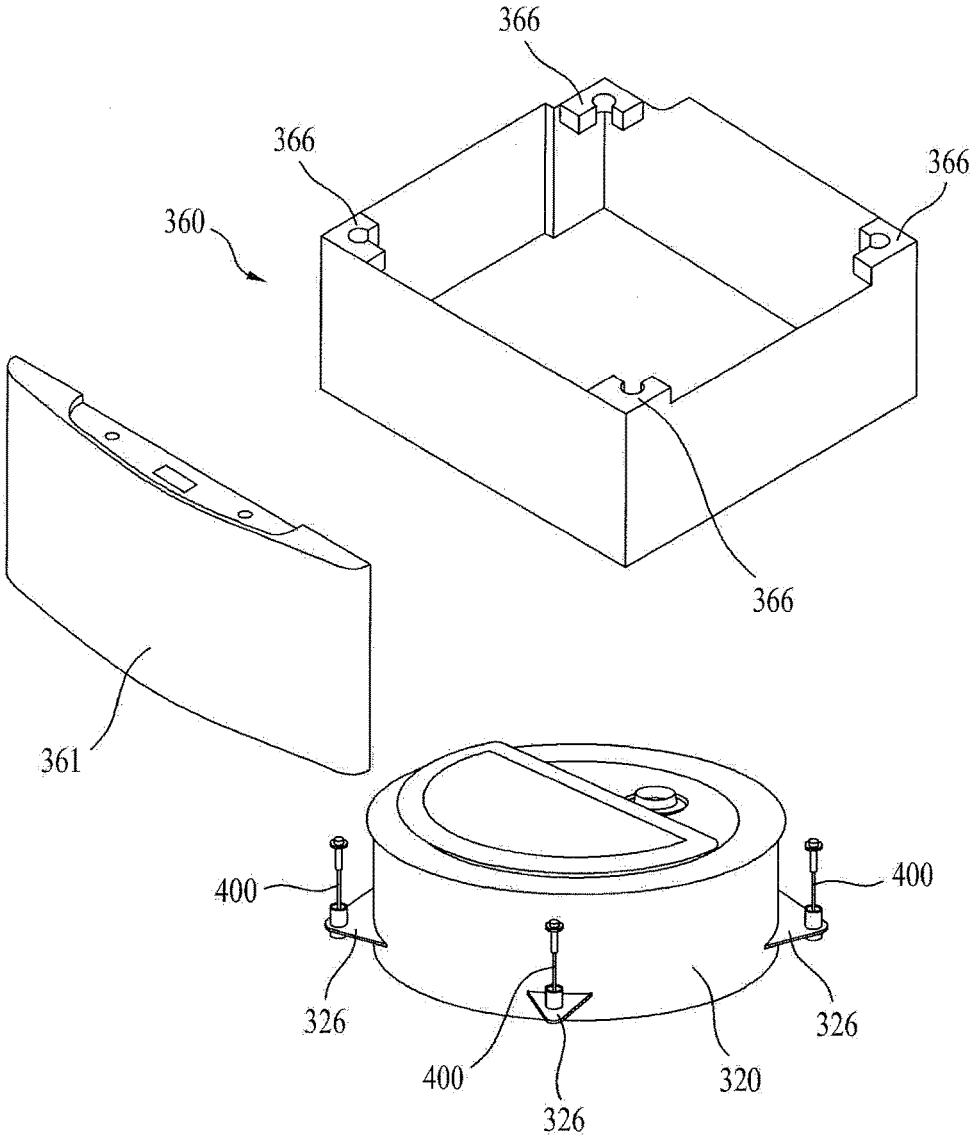

LAUNDRY TREATMENT APPARATUS

This application claims the benefit of Korean Patent Application No. 10-2014-0098830, filed on Aug. 1, 2014, which is hereby incorporated by reference as if fully set forth herein.

FIELD

The present application relates to a laundry treatment apparatus, and more particularly, to a laundry treatment apparatus in which a main washing apparatus is additionally provided with a secondary washing apparatus for treating laundry.

BACKGROUND

Generally, a laundry treatment apparatus refers to an apparatus designed to execute washing of laundry using detergent and mechanical friction. A typical laundry treatment apparatus may be directly installed on the floor. In some cases, a front-loading laundry treatment apparatus (also called a drum washing machine) may have an introduction port positioned at a relatively low level, through which laundry is put into the apparatus. In such cases, a user may have to stoop in order to put laundry into the apparatus or take laundry out of the apparatus.

In some cases, a support platform may be provided under a front-loading laundry treatment apparatus (i.e. a main washing apparatus) so as to raise the height of an introduction port of the laundry treatment apparatus. In some cases, a secondary washing apparatus may be provided under the main washing apparatus.

In general, a secondary washing apparatus is a top-loading washing apparatus having a drawer shape, capable of being withdrawn from the main washing apparatus so as to allow laundry to be put thereinto from above. A typical secondary washing apparatus may have a capacity lower than that of the main washing apparatus.

For the secondary washing apparatus, vibrations of a rotating drum may be transmitted to the drawer through a tub. The vibrations of the drawer may further be transmitted to the outer cabinet, thus causing the whole laundry treatment apparatus to vibrate.

In some cases, shock absorbers, such as a damper or a suspension may be used to reduce or prevent such vibrations. If the damper or suspension for absorbing vibrations generated from a drum is installed in the interior space of the drawer, the capacity of the tub of the secondary washing apparatus may be further reduced by the need for space for installation of the damper of suspension.

SUMMARY

According to one aspect, a washing apparatus includes a cabinet defining an external appearance of the secondary washing apparatus, a drawer housing configured to be pushed in or withdrawn from the cabinet, a tub disposed in the drawer housing and configured to receive washing water, a plurality of hanging couplers provided at an outer circumferential surface of the tub and spaced apart from each other by predetermined distances, a plurality of suspending couplers provided at the drawer housing and positioned at locations corresponding to the plurality of hanging couplers, a drum rotatably provided in the tub, and a plurality of suspension assemblies provided between the drawer housing and the tub and configured to attenuate horizontal and vertical vibrations of the tub, the suspension assemblies being disposed between respective hanging couplers and suspending couplers to thereby support the tub. Each of the suspension assemblies includes a support bar, support members that are provided at both ends of the support bar and through which the support bar is configured to extend, and an elastic member disposed on the support member provided at one end of the support bar.

Implementations according to this aspect may include one or more of the following features. For example, wherein one end of each of the plurality of suspension assemblies may be coupled a corresponding hanging coupler, and the other end is coupled to a corresponding suspending coupler, and the suspending couplers may be positioned vertically above the hanging couplers. At least one of the plurality of hanging couplers may be configured to extend in a tangential direction of the outer circumferential surface of the tub. Each of the hanging couplers may include a bracket defining a coupling hole, and a portion of the elastic member may be disposed in the coupling hole, and the remaining portion of the elastic member extends through the coupling hole. In some cases, the bracket of the hanging coupler may include a support rib projecting toward the coupling hole, and the elastic member may have a cylindrical shape and includes a buffer rib located at a lower portion and projecting radially outward, the buffer rib being disposed under the support rib to contact the support rib. The support member provided at the one end of the support bar may include a hemispheric support surface, and a positioning member configured to position the elastic member may be disposed between a lower end of the elastic member and the hemispheric support surface. A lower portion of the elastic member includes one of a groove and a protrusion and the positioning member may include the other of the groove and the protrusion such that the protrusion is fitted into the groove to position the elastic member.

In some implementations, the support member provided at the one end of the support bar may have a length longer than the elastic member, and based on the tub vibrating horizontally, an outer surface of the support member may be configured to contact an inner surface of the elastic member. In some cases, the outer circumferential surface of the tub may include three hanging couplers spaced apart from one another by predetermined distances, and three suspending couplers may be provided on the drawer housing at positions corresponding to the hanging couplers, with three suspension assemblies being disposed between the hanging couplers and the suspending couplers to thereby support the tub. In some cases, the outer circumferential surface of the tub may include four hanging couplers spaced apart from one another by predetermined distances, and four suspending couplers may be provided on the drawer housing at positions corresponding to the hanging couplers, with four suspension assemblies being disposed between the hanging couplers and the suspending couplers to thereby support the tub. At least one of three hanging couplers may be disposed toward a rear of the laundry treatment apparatus and configured to extend in a tangential direction of the outer circumferential surface of the tub. At least one of four hanging couplers may be disposed toward a rear of the laundry treatment apparatus and configured to extend in a tangential direction of the outer circumferential surface of the tub. The suspension assemblies may be disposed between an inner surface of the drawer housing and the outer circumferential surface of the tub.

According to another aspect, washing apparatus, which is configured to be placed under a laundry treatment apparatus, includes a cabinet defining an external appearance of the washing apparatus, a drawer housing configured to be pushed in or withdrawn from the cabinet, a tub disposed in the drawer housing and configured to receive washing water, a plurality of hanging couplers provided at an outer circumferential surface of the tub and spaced apart from each other by predetermined distances, a plurality of suspending couplers provided at the drawer housing and positioned at locations corresponding to the plurality of hanging couplers, a drum rotatably provided in the tub, and a plurality of suspension assemblies provided between the drawer housing and the tub and configured to attenuate horizontal and vertical vibrations of the tub, the suspension assemblies being disposed between respective hanging couplers and suspending couplers to thereby support the tub. Each of the suspension assemblies includes a support bar, support members that are provided at both ends of the support bar and through which the support bar is configured to extend, and an elastic member disposed on the support member provided at one end of the support bar.

Implementations according to this aspect may include one or more of the following features. For example, one end of each of the plurality of suspension assemblies may be coupled a corresponding hanging coupler, and the other end is coupled to a corresponding suspending coupler, and the suspending couplers may be positioned vertically above the hanging couplers. In some cases, at least one of the plurality of hanging couplers may be configured to extend in a tangential direction of the outer circumferential surface of the tub. Each of the hanging couplers may include a bracket defining a coupling hole, and a portion of the elastic member may be disposed in the coupling hole, and the remaining portion of the elastic member extends through the coupling hole. The bracket of the hanging coupler may include a support rib projecting toward the coupling hole, and the elastic member may have a cylindrical shape and include a buffer rib located at a lower portion and projecting radially outward, the buffer rib being disposed under the support rib to contact the support rib. The support member provided at the one end of the support bar may include a hemispheric support surface, and a positioning member configured to position the elastic member may be disposed between a lower end of the elastic member and the hemispheric support surface. A lower portion of the elastic member may include one of a groove and a protrusion, and the positioning member may include the other of the groove and the protrusion such that the protrusion may be fitted into the groove to position the elastic member.

BRIEF DESCRIPTION OF THE DRAWINGS

FIG. 1 is a perspective view showing an example laundry treatment apparatus;

FIG. 2 is a schematic cross-sectional view showing the example laundry treatment apparatus;

FIG. 3 is a view showing an example secondary washing apparatus in which suspension assemblies are installed;

FIG. 4 is an exploded perspective view showing an example suspension assembly shown in FIG. 3;

FIG. 5 is a schematic cross-sectional view illustrating an operation of the example suspension assembly;

FIG. 6 is a perspective view showing an example of hanging couplers provided on the outer surface of a tub (i.e. a second tub) included in the secondary washing apparatus; and FIG. 7 is an exploded perspective view showing an example arrangement of the suspension assemblies provided between the tub and a drawer housing.

DETAILED DESCRIPTION

FIGS. 1 and 2 illustrate an example laundry treatment apparatus according to an implementation of the present disclosure.

Referring to FIGS. 1 and 2, a laundry treatment apparatus 100 may include a main washing apparatus 200 and a secondary washing apparatus 300. The secondary washing apparatus 300 may be disposed beside or under the main washing apparatus 200. The main washing apparatus 200 may include a first cabinet 210 defining an external appearance thereof, and the secondary washing apparatus 300 may include a second cabinet 310 defining an external appearance thereof. The first cabinet 210 and the second cabinet 310 may be integrally formed with each other. In some cases, the laundry treatment apparatus may include just one of the main washing apparatus 200 or the secondary washing apparatus 300.

As shown in FIG. 2, the main washing apparatus 200 includes the first cabinet 210 defining the external appearance thereof, a first tub 220 disposed in the first cabinet 210 to contain washing water, and a first drum 230 rotatably disposed in the first tub 220 to contain laundry.

The first drum 230 may be rotated in the first cabinet 210 by a first motor 240 disposed outside the first tub 220. In some cases, a first shaft 241 of the first motor 240 may extend through the rear surface of the first tub 220 and be connected to the rear surface of the first drum 230. Accordingly, the driving force of the first motor 240 may be transmitted to the first drum 230 through the first shaft 241.

In some cases, the first drum 230 may be provided on the inner surface thereof with one or more lifters 231 capable of lifting laundry contained in the first drum 230 and then allowing the laundry to fall. The first cabinet 210 may be provided therein with a water supply unit 110 for supplying washing water to the first tub 220 and a second tub 320 of the secondary washing apparatus 300, and a water discharge unit 120 for discharging washing water from the first tub 220 and the second tub 320 after completion of the laundry.

The water supply unit 110 may include a water supply pump and a supply line 111, and the water discharge unit 120 may include a water discharge pump and a water discharge pipe. The water supply unit 110 is connected to the supply line 111, through which washing water is supplied from a water source. Washing water, which is supplied to the water supply unit 110, may be selectively supplied to the first tub 220 along a first line 112 through a detergent container 260, or to a second tub 320 (which will be described later) of the secondary washing apparatus 300 along a second line 113.

In order to supply washing water to the first tub 220 or the second tub 320 in a selective manner, the first line 112 and the second line 113 may be provided with a first valve 114 and a second valve 115, respectively.

One or more dampers 270 may be disposed between the first cabinet 210 and the first tub 220 so as to absorb vibrations transmitted to the first tub 220 due to the rotation of the first drum 230. Furthermore, a damper (for example, a cylinder damper) may be disposed between the first tub 220 and the cabinet of the secondary washing apparatus 300.

The damper may include a spring damper or a cylinder damper, among others. A control panel 280 for controlling the main washing apparatus 200 may be provided on the upper front area of the first cabinet 210.

The secondary washing apparatus 300 may be disposed close to the main washing apparatus 200. For example, to improve a user's convenience in using the main washing apparatus 200, the secondary washing apparatus 300 may be disposed under the main washing apparatus 200. In this way, the secondary washing apparatus 300 may raise the height of the door 250 of the main washing apparatus 200 to be at a more convenient height for the user.

When the main washing apparatus 200 is provided together with the secondary washing apparatus 300, the main washing apparatus 200 and the secondary washing apparatus 300 may be configured to have the same washing capacity. However, in consideration of restricted installation space of the laundry treatment apparatus 100 and the cost of manufacturing the laundry treatment apparatus 100, one of the main washing apparatus 200 and the secondary washing apparatus 300 may be configured to have a larger capacity than the other.

In one implementation, the secondary washing apparatus 300 may be configured to be smaller than the main washing apparatus 200 in at least one of washing capacity, volume, and height, as shown in FIGS. 1 and 2. Therefore, a user may appropriately select to use either the main washing apparatus 200 or the secondary washing apparatus 300 based on the amount of laundry to be washed.

Additionally, a user may select and use one of the main washing apparatus 200 and the secondary washing apparatus 300 in accordance with the type of laundry. For example, babies' wear, underwear or the like, which may require separate washing, may be washed using the secondary washing apparatus 300, and other laundry may be washed using the main washing apparatus 200.

As illustrated, the secondary washing apparatus 300 is a top-loading type washing apparatus. In particular, the secondary washing apparatus 300 may include the second cabinet 310 defining the external appearance thereof, a drawer housing 360 which may be pushed into or withdrawn from the second cabinet 310, the second tub 320 disposed in the drawer housing 360 to contain washing water, and a second drum 330 rotatably disposed in the second tub 320 to contain laundry therein. A water discharge unit for discharging washing water may be disposed beside the second tub 320.

The drawer housing 360 may be pushed into or withdrawn from the second cabinet 310 through an opening 350 formed in the second cabinet 310 and facing the forward direction of the laundry treatment apparatus 100.

The second drum 330 may be rotated in the drawer housing 360 by a second motor 340 disposed outside the second tub 320. In some cases, a second shaft 341 of the second motor 340 may extend through the bottom surface of the second tub 320 and be connected to the bottom surface of the second drum 330. Consequently, the driving force of the second motor 340 may be transmitted to the second drum 330 through the second shaft 341.

The drawer housing 360 may be provided at the front surface thereof with a cover panel 361. The cover panel 361 may be integrally formed with the drawer housing 360. The cover panel 361 may further be provided with a handle 362 so as to enable the drawer housing 360 to be pushed in or pulled out, and may further be provided at an upper surface thereof with a control panel 380 for controlling the secondary washing apparatus 300.

The drawer housing 360 may be provided at an upper portion thereof with a washing water supply hole 365 for allowing washing water to be supplied to the second tub 320, and may be provided with a door 363 for allowing laundry to be put into or taken out of the second drum 330. The door 363 may be provided with a cover handle 364 for enabling the door 363 to be pulled and opened by a user.

In order to absorb vibrations generated by rotation of the second drum 330, one or more suspension assemblies 400 may be provided between the drawer housing 360 and the second tub 320. In some cases, vibrations generated by rotation of the second drum 330 may be transmitted to the second tub 320, and may in turn be transmitted to the second cabinet 310 of the secondary washing apparatus 300.

In order to absorb such vibrations, the suspension assemblies 400 may be installed between the drawer housing 360 and the second tub 320. The suspension assemblies 400 can serve to connect the drawer housing 360 and the second tub 320 such that the drawer housing 360 can support the vertical load of the second tub 320. Consequently, the second tub may be maintained in the state of being suspended in the drawer housing 360 by the suspension assemblies 400. Furthermore, the suspension assemblies 400 can serve to attenuate horizontal and vertical vibrations of the second tub 320.

One implementation of the suspension assembly will now be described in detail with reference to the accompanying drawings.

FIG. 3 illustrates example suspension assemblies 400 installed within the secondary washing apparatus 300.

Referring to FIG. 3, the suspension assemblies 400 may be installed between the second tub 320 and the drawer housing 360. For example, the suspension assemblies 400 may be installed between the outer surface of the second tub 320 and the inner surface of the drawer housing 360.

In some cases, the second tub 320 may be provided at the outer surface thereof with one or more hanging couplers 326, and the drawer housing 360 may be provided with one or more suspending couplers 366 at positions thereof corresponding to the respective hanging couplers 326. For example, the hanging couplers 326 may project toward the inner surface of the drawer housing 360 from the outer surface of the second tub 320, and the suspending couplers 366 may project toward the center of the drawer housing 360 from the inner surface of the drawer housing 360.

The hanging couplers 326 may include a plurality of hanging couplers, which are disposed on the outer surface of the second tub 320 at predetermined intervals, and the suspending couplers 366 may include a plurality of suspending couplers, which are disposed on the inner surface of the drawer housing 360. The hanging couplers 326 may be integrally formed with the second tub 320, and the suspending couplers 266 may be integrally formed with the drawer housing 360.

The hanging coupler 326 and the corresponding suspending coupler 366 may be disposed to be vertically spaced apart from each other. For example, the hanging coupler 326 may be provided on a lower area of the outer surface of the second tub 320, and the suspending coupler 366 may be provided on an upper area of the inner surface of the drawer housing 360. The suspension assembly 400 may be installed between the hanging coupler 326 and the suspending coupler 366. For example, the suspending coupler 366 may be disposed at a level higher than the hanging coupler 326.

In some cases, the suspension assembly 400 may have a longitudinally elongated shape. One end of the suspension assembly 400 may be coupled to the hanging coupler 326, and the other end of the suspension assembly 400 may be coupled to the suspending coupler 366. Accordingly, the suspension assembly 400 may support the second tub 320 in the state of floating in the drawer housing 360 (i.e., in the state in which the outer surface of the second tub 320 does not contact the inner surface of the drawer housing).

The suspension assembly 400 according to one implementation of the present disclosure may include a support bar 410 having a predetermined length, and support members 420 and 421, which are provided at one end 411 and the other end 412 of the support bar 410, and though which the support bar 410 extends.

In particular, the support bar 410 may extend through the support members 420 and 421, and may be coupled thereto. In some cases, the support members 420 and 421 may be configured to surround the one end 411 and the other end 412 of the support bar 410, respectively.

For example, the first support member 420 may be coupled to the support bar 410 such that the two support members 420 and 421 surround the one end 411 and the other end 412 of the support bar 410 by predetermined lengths. Here, the first support member 420 may surround the one end 411 of the support bar 410, and the second support member 421 may surround the other end 412 of the support bar 410. Each of the support members 4210 and 421 may be less than half of the length of the support bar 410.

When the suspension assembly 400 is vertically installed between the second tub 320 and the drawer housing 360, an elastic member 430 may be disposed around the first support member 420 provided at the one end 411 of the support bar 410. For example, the elastic member 430 may be made of a rubber or elastomer material. The elastic member 430 is configured to have a cylindrical shape, and the support member 420 may extend through the elastic member 430.

The hanging coupler 326 of the second tub 320 may be configured to surround the elastic member 430. In other words, the one end of the suspension assembly 400 may be coupled to the hanging coupler 326, and the elastic member 430 may be interposed between the one end 401 of the suspension assembly 400 and the hanging coupler 326.

Accordingly, horizontal vibrations of the second tub 320 may be absorbed by the elastic member 430. Specifically, when the second tub 320 vibrates horizontally, at least a portion of the first support member 420 provided at the suspension assembly 400 may come into contact with the inner surface of the elastic member 430, thus absorbing the horizontal vibrations of the second tub 320.

Hereinafter, the specific construction of the suspension assembly 400 according to the implementation of the present disclosure and the principle of vibration absorption by the suspension assembly 400 will now be described with reference to FIGS. 4 and 5.

As described above, the suspension assembly 400 may include the support bar 410, the support members 420 and 421, which are provided at the one end 411 and the other end 412 of the support bar 410, respectively, and through which the support bar 410 extends, and the elastic member 430 disposed around the first support member 420 provided at the one end 411 of the support bar 410.

Specifically, the support bar 410 may extend through the two support members 420 and 421, and may be coupled thereto. The elastic member 430 may be disposed such that the first support member 420 provided at the one end 411 of the support bar 410 extends through the elastic member 430.

The hanging coupler 326 provided on the outer surface of the second tub 320 may be a bracket defining a coupling hole 327. In some cases, the hanging coupler 326 may be configured to project toward the inner surface of the drawer housing 360 from the outer surface of the second tub 320.

At least a portion of the elastic member 430 may be disposed in the coupling hole 327 defined in the hanging coupler 326, and the remaining portion of the elastic member 430 may extend through the coupling hole 327. In some cases, the remaining portion of the elastic member 430 may extend upward through the coupling hole 327 from below. At this point, the outer surface of the elastic member 430 can be maintained in the state of contacting the inner surface of the coupling hole 327.

Accordingly, when the second tub 320 vibrates horizontally, the support bar 410 and the first support member 420 are inclined horizontally. At this time, the outer surface of the first support member 420 can come into contact with the inner surface of the elastic member 430, and thus the horizontal vibrations of the second tub 320 may be absorbed by the elastic member 430.

For example, the first support member 420, coupled to the one end 411 of the support bar 410, may have a length longer than that of the elastic member 430. Specifically, opposite ends of the first support member 420 extend outward beyond opposite ends of the elastic member 430. Accordingly, when the second tub 320 vibrates horizontally, the horizontal vibrations may be absorbed by the contact between the outer surface of the first support member 420 and the inner surface of the elastic member 430.

For instance, when the support bar 410 is inclined horizontally due to the horizontal vibrations of the second tub 320, the support bar 410 may not directly contact the inner surface of the elastic member 430, but the outer surface of the first support member 420 may contact the inner surface of the elastic member 430.

The bracket of the hanging coupler 326 may include a support rib 328 projecting toward the center of the coupling hole 327 therefrom. The elastic member 430 may be provided at the lower end thereof with a buffer rib 431 projecting outward. For example, the cylindrical elastic member 430 may be provided at the lower end thereof with the buffer rib 431, which is circumferentially formed along the lower end and projects outward. In one example, the buffer rib 431 can be made of the same material as the elastic member 430, and the support rib 328 can be integrally formed with the hanging coupler 326.

When the elastic member 430 is disposed to extend through the coupling hole 327, the buffer rib 431 may be disposed to contact the support rib 328. For instance, when the one end 401 of the suspension assembly 400 is coupled to the hanging coupler 326, the buffer rib 431 of the elastic member 430 may be disposed to contact the support rib 328 of the hanging coupler 326. For example, the upper surface of the buffer rib 431 may be disposed to contact the lower surface of the support rib 328.

Based on this arrangement, even though the second tub 320 vibrates vertically (i.e. up and down), the vertical vibrations may be absorbed by the buffer rib 431 of the elastic member 430, disposed under the support rib 328 of the hanging coupler 326.

The first support member 420, provided at the one end 411 of the support bar 410, may have a hemispheric surface. For example, the first support member 420 may have a hemispheric support surface 423, which is convex upward. A positioning member 440 may be disposed between the elastic member 430 and the support surface 423 so as to position the elastic member 430. For example, the positioning member 440 may be disposed between the lower end of the elastic member 430 and the hemispheric surface, which is convex upward.

Specifically, the elastic member 430 may be provided at the lower end thereof with one or more grooves 432. For example, the buffer rib 431 of the elastic member 430 may be provided with a plurality of grooves 432 at predetermined intervals. The positioning member 440 may be provided with one or more protrusions 442 corresponding to the one or more grooves 432 formed in the elastic member 430. Consequently, the elastic member 430 may be positioned by fitting the one or more protrusions 442 in the one or more corresponding grooves 432.

For instance, the elastic member 430 may be held on the positioning member 440 disposed on the support surface 423 of the first support member 420. Alternatively, the elastic member 430 may also be held on the positioning member 440 in such a way that the elastic member 430 is provided at the lower end with one or more grooves and the positioning member 440 is provided with one or more grooves.

The hanging coupler 326 may include an incision opening 325 formed at a portion thereof, and the positioning member 440 may include a fitting protrusion 445 corresponding to the incision opening 325 (see FIGS. 3 and 4). Accordingly, after the elastic member 430 is held on the positioning member 440 in this way, the fitting protrusion 455 of the positioning member 440 is fitted into the incision opening 325 in the hanging coupler 326, and, in this way, the one end 401 of the suspension assembly 400 may be coupled to the hanging coupler 326.

Furthermore, fitting the fitting protrusion 455 of the positioning member 440 into the incision opening 325 in the hanging coupler 326 may prevent the one end 401 of the suspension assembly 400 from rotating in the coupling hole 327 in the hanging coupler 326. In other words, by fitting the fitting protrusion 455 into the incision opening 325, rotation of the suspension assembly 400 about the longitudinal axis of the suspension assembly 400 may be prevented.

The second support member 421 provided on the other end 412 of the support bar 410 may also include a hemispheric surface 424. For example, the second support member 421 may include a hemispheric support surface 424, which is convex downward.

The hemispheric support surface 424, which is convex downward, may be placed on the corresponding surface formed on the suspending coupler 366 provided at the drawer housing 360. Specifically, the suspending coupler 366 of the drawer housing 360 may include a concave surface corresponding to the hemispheric support surface 424, which is convex downward, and the hemispheric support surface 424, which is convex downward, may be placed on the concave surface.

In this way, both the horizontal and vertical vibrations of the second tub 320 may be absorbed by the elastic member 430 provided at the suspension assembly 400. Specifically, when the second tub 320 vibrates horizontally, the first support member 420 provided at the one end 411 of the support bar 410 comes into contact with the inner surface of the cylindrical elastic member 430 having a predetermined length, thus absorbing the horizontal vibrations.

Furthermore, when the second tub 320 vibrates vertically, the vertical vibrations may be absorbed by the buffer rib 431 of the elastic member 430 disposed under the support rib 328 of the hanging coupler 326.

FIG. 6 illustrates the hanging couplers 326 provided on the outer surface of the tub (i.e. the second tub 320) included in the secondary washing apparatus. FIG. 7 illustrates an arrangement of the suspension assemblies 400 as provided between the tub 320 and the drawer housing 360.

Referring to FIGS. 6 and 7, the secondary washing apparatus 300 may include the second tub 320 provided in the drawer housing 360, the second drum 330 rotatably provided in the second tub 320, and a pulsator 370 rotatably provided at the center of the second drum 330. The pulsator 370 may be provided at the center thereof with a mesh cap 371 for filtering extraneous substances, such as lint, which may be included in washing water.

A base 331 of the second drum 330 may be provided with one or more drum wings 332. Specifically, the drum wings 332 may project upward from the base 331 of the second drum 330. Furthermore, the drum wings 332, which are formed at the base 331 of the second drum 330, may extend toward the outer circumference of the second drum 330. The drum wings 332 may include a plurality of drum wings, which are disposed on the base 331 of the second drum 330 at predetermined intervals (i.e. at predetermined angular distances).

Accordingly, a vortex may be generated in the washing water in the second drum 330 by the rotation of the second drum 330 and the pulsator 370, thus improving washing efficiency.

The base 331 of the second drum 330 may be provided with a plurality of water discharge holes 333 formed therein. In some cases, the water discharge holes 333 may also be defined in the lateral side surface of the second drum 330.

The second tub 320 may be provided on the outer circumferential surface thereof with the plurality of hanging couplers 326, which are spaced apart from one another by predetermined distances. In other words, the second tub 320 may be provided on the outer circumferential surface thereof with the plurality of hanging couplers 326, which are spaced apart from one another by predetermined angular distances. Although FIGS. 6 and 8 illustrate four hanging couplers 326, which are provided on the outer circumferential surface of the second tub 320 at predetermined spacing distances, three hanging couplers 326 may also be provided on the outer circumferential surface of the second tub 320 at predetermined spacing distances.

The drawer housing 360 may be provided with the suspending couplers 366 at positions corresponding to the hanging couplers 326. The suspending couplers 366 may be disposed vertically spaced apart from the hanging couplers 326.

For example, the suspending couplers 366 may be disposed over the hanging couplers 326 at positions spaced apart from the hanging couplers 326 by a predetermined distance. The suspending couplers 366, which are provided at the drawer housing 360, may be provided in the same number as the number of the hanging couplers 326. In other words, when four hanging couplers 326 are provided at the outer circumferential surface of the second tub 320, the drawer housing 360 may also be provided with four suspending couplers 366 corresponding to the hanging couplers 326. In addition, when three hanging couplers 326 are provided at the outer circumferential surface of the second tub 320, the drawer housing 360 may also be provided with three suspending couplers 366 corresponding to the hanging couplers 326.

The suspension assemblies 400, which have been described in detail with reference to FIGS. 3 to 5, may be installed between the hanging couplers 326 and the suspending couplers 366 so as to support the second tub 320. Specifically, the suspension assemblies 400 may include a plurality of suspension assemblies 400, which are disposed between the plurality of hanging couplers 326 and the plurality of corresponding suspending couplers 366.

For example, when four hanging couplers 326 are provided at the outer circumferential surface of the second tub 320 and four corresponding suspending couplers 366 are provided at the drawer housing 360, four suspension assemblies 400 may be installed between the respective hanging couplers 326 and the corresponding suspending couplers 366.

When three hanging couplers 326 are provided at the outer circumferential surface of the second tub 320 and three corresponding suspending couplers 366 are provided at the drawer housing 360, three suspension assemblies 400 may be installed between the respective hanging couplers 326 and the corresponding suspending couplers 366. In other words, one suspension assembly 400 is disposed between one hanging coupler 326 and one suspending coupler 366.

When four hanging couplers 326 are provided at the outer circumferential surface of the second tub 320, four hanging couplers 326 may be disposed to be pointed toward four corners of the drawer housing 360.

Specifically, the hexahedral drawer housing 360 has four corners, and four hanging couplers 326 project toward four corners from the outer circumferential surface of the second tub 320. Thanks to the arrangement of the hanging couplers 326, it is possible to efficiently utilize the internal space of the drawer housing 360 and thus to maximize the capacity of the second tub 320.

Some of the plurality of hanging couplers 326 may be configured to extend in the tangential direction of the outer circumferential surface of the second tub 320.

For example, two of four hanging couplers 326, which project toward the front of the drawer housing 360, may be configured to extend in the diametrical direction of the second tub 320, and the other two hanging couplers 326, which project toward the rear of the drawer housing 360, may be configured to extend in the tangential direction of the outer circumferential surface of the second tub 320.

Because the hanging couplers 326 are configured to extend in the tangential direction of the outer circumferential surface of the second tub 320, it may be possible to reduce the space between the rear surface of the drawer housing 360 and the second tub 320. Consequently, it may be possible to maximize the capacity of the second tub 320.

When three hanging couplers 326 are provided at the outer circumferential surface of the second tub 320, two of the hanging couplers 326 may be disposed to be pointed toward two rear corners of the drawer housing 360, and the one hanging coupler 326 may be disposed toward the front of the drawer housing 360.

As described above, the present disclosure may provide a laundry treatment apparatus capable of absorbing vibrations generated from the secondary washing apparatus. Specifically, horizontal and vertical vibrations of the secondary washing apparatus may be efficiently absorbed by the suspension assemblies. Furthermore, by minimizing the space required to install a vibration absorbing mechanism in the secondary washing apparatus, the capacity of the tub may be increased.

It will be apparent to those skilled in the art that various modifications and variations can be made without departing from the spirit or scope of the disclosure. Thus, it is intended that the present disclosure covers modifications and variations provided they come within the scope of the appended claims and their equivalents.

What is claimed is:

1. A laundry treatment apparatus comprising:

a tub configured to receive washing water;

a housing that accommodates the tub;

a plurality of hanging couplers provided at an outer circumferential surface of the tub and spaced apart from each other by predetermined distances, each of the plurality of hanging couplers including a bracket that defines a coupling hole;

a plurality of suspending couplers provided at the housing and positioned at locations corresponding to the plurality of hanging couplers;

a drum rotatably provided in the tub; and a plurality of suspension assemblies provided between the housing and the tub and configured to attenuate horizontal and vertical vibrations of the tub, the suspension assemblies being disposed between respective hanging couplers and suspending couplers to thereby support the tub, wherein each of the suspension assemblies comprises:

a support bar, support members that are provided at both ends of the support bar, an elastic member disposed at one end of the support bar, the elastic member including one of grooves or protrusions, and a positioning member configured to couple to the elastic member and to restrict rotation of the elastic member relative to the positioning member, wherein the positioning member includes the other of the grooves or the protrusions such that the protrusions are fitted into the grooves to restrict rotation of the elastic member relative to the positioning member.

2. The laundry treatment apparatus according to claim 1, wherein the bracket of the hanging coupler includes a support rib projecting toward the coupling hole, and the elastic member includes a buffer rib located at a lower portion and projecting radially outward, the buffer rib being disposed under the support rib to contact the support rib.

3. The laundry treatment apparatus according claim 2, wherein the buffer rib defines the grooves that are spaced apart at a predetermined interval along a circumference of the buffer rib.

4. The laundry treatment apparatus according to claim 1, wherein the support member provided at the one end of the support bar has a length longer than the elastic member, and wherein, based on the tub vibrating horizontally, an outer surface of the support member is configured to contact an inner surface of the elastic member.

5. The laundry treatment apparatus according to claim 1, wherein three hanging couplers are provided on the outer circumferential surface of the tub, and three suspending couplers are provided on the housing at positions corresponding to the hanging couplers, wherein three suspension assemblies are disposed between the hanging couplers and the suspending couplers to thereby support the tub.

6. The laundry treatment apparatus according to claim 5, wherein at least one of three hanging couplers is disposed toward a rear of the laundry treatment apparatus and configured to extend in a tangential direction of the outer circumferential surface of the tub.

7. The laundry treatment apparatus according to claim 1, wherein four hanging couplers are provided on the outer circumferential surface of the tub, and four suspending couplers are provided on the housing at positions corresponding to the hanging couplers, wherein four suspension assemblies are disposed between the hanging couplers and the suspending couplers to thereby support the tub.

8. The laundry treatment apparatus according to claim 7, wherein at least one of four hanging couplers is disposed toward a rear of the laundry treatment apparatus and configured to extend in a tangential direction of the outer circumferential surface of the tub.

9. The laundry treatment apparatus according to claim 1, wherein the suspension assemblies are disposed between an inner surface of the housing and the outer circumferential surface of the tub.

10. The laundry treatment apparatus according to claim 1, wherein the elastic member has a cylindrical shape and surrounds the corresponding support member, wherein a portion of the elastic member is disposed within the coupling hole, and the remaining portion of the elastic member extends out of the coupling hole, and wherein an inner diameter of the elastic member is greater than a diameter of the support member such that a space is defined between an inner surface of the elastic member and an outer surface of the support member.

11. The laundry treatment apparatus according to claim 1, wherein the positioning member is disposed between the elastic member and one of the support members.

12. The laundry treatment apparatus according to claim 1, wherein the positioning member has a ring shape that surrounds an outer peripheral surface of the support bar.

13. The laundry treatment apparatus according claim 1, wherein the bracket further defines a cut-out portion at one side of the coupling hole, and wherein at least one of the protrusions of the positioning member is configured to fit into the cut-out portion.

14. A washing apparatus that is configured to be placed under a laundry treatment apparatus, the washing apparatus comprising:

a cabinet defining an external appearance of the washing apparatus;

a drawer housing configured to be pushed in or withdrawn from the cabinet;

a tub disposed in the drawer housing and configured to receive washing water;

a plurality of hanging couplers provided at an outer circumferential surface of the tub and spaced apart from each other by predetermined distances, each of the plurality of hanging couplers including a bracket that defines a coupling hole;

a plurality of suspending couplers provided at the drawer housing and positioned at locations corresponding to the plurality of hanging couplers;

a drum rotatably provided in the tub; and a plurality of suspension assemblies provided between the drawer housing and the tub and configured to attenuate horizontal and vertical vibrations of the tub, the suspension assemblies being disposed between respective hanging couplers and suspending couplers to thereby support the tub, wherein each of the suspension assemblies comprises:

a support bar, support members that are provided at both ends of the support bar, an elastic member disposed at one end of the support bar, the elastic member including one of grooves or protrusions, and a positioning member configured to couple to the elastic member and to restrict rotation of the elastic member relative to the positioning member, wherein the positioning member includes the other of the grooves or the protrusions such that the protrusions are fitted into the grooves to restrict rotation of the elastic member relative to the positioning member.

15. The washing apparatus according to claim 14, wherein the bracket of the hanging coupler includes a support rib projecting toward the coupling hole, and the elastic member includes a buffer rib located at a lower portion and projecting radially outward, the buffer rib being disposed under the support rib to contact the support rib.

16. The washing apparatus according claim 15, wherein the buffer rib defines the grooves that are spaced apart at a predetermined interval along a circumference of the buffer rib.

17. The washing apparatus according to claim 14, wherein the elastic member has a cylindrical shape and surrounds the corresponding support member, wherein a portion of the elastic member is disposed within the coupling hole, and the remaining portion of the elastic member extends out of the coupling hole, and wherein an inner diameter of the elastic member is greater than a diameter of the support member such that a space is defined between an inner surface of the elastic member and an outer surface of the support member.

18. The washing apparatus according to claim 14, wherein the positioning member is disposed between the elastic member and one of the support members.

19. The washing apparatus according to claim 14, wherein the positioning member has a ring shape that surrounds an outer peripheral surface of the support bar.

20. The washing apparatus according claim 14, wherein the bracket further defines a cut-out portion at one side of the coupling hole, and wherein at least one of the protrusions of the positioning member is configured to fit into the cut-out portion.

* * * * *